US006219986B1

(12) United States Patent
Ouchi

(10) Patent No.: US 6,219,986 B1
(45) Date of Patent: Apr. 24, 2001

(54) METHOD FOR REINFORCING WALL STRUCTURE

(75) Inventor: Hajime Ouchi, Saitama (JP)

(73) Assignee: Obayashi Corporation, Osaka (JP)

( * ) Notice: Subject to any disclaimer, the term of this patent is extended or adjusted under 35 U.S.C. 154(b) by 0 days.

(21) Appl. No.: 09/286,960

(22) Filed: Apr. 6, 1999

(30) Foreign Application Priority Data

Apr. 17, 1998 (JP) ..... 10-107293

(51) Int. Cl.[7] ..... B65B 3/26; B65B 57/02

(52) U.S. Cl. ..... 52/506.05; 52/746.1; 52/741.1; 52/425; 52/DIG. 7

(58) Field of Search ..... 52/506.05, 514, 52/514.5, 425, DIG. 7, 746.1

(56) References Cited

U.S. PATENT DOCUMENTS 5,469,674 * 11/1995 Morello ..... 52/86

* cited by examiner

*Primary Examiner*—Carl D. Friedman
*Assistant Examiner*—Patrick J. Chavez

(74) *Attorney, Agent, or Firm*—Dougherty & Clements LLP

(57) ABSTRACT

A method for reinforcing an existing wall structure which is capable of preventing buckling of end surfaces of the wall structure and increasing earthquake-resistance ability by imparting restricting force evenly to the end surfaces of the wall structure. The method includes the steps of: attaching steel segments in a plurality of stages onto a wall surface of the existing pier, each of the steel segments being formed into a column having a continuous cross-section in the shape of a circular-arc, and being integrally provided with flanges for connection on both sides of each circular-arc column in the width direction; allowing a plurality of PC steel bars to pass through a plurality of holes pierced in the flanges and through a plurality of holes pierced through the existing pier in the direction of the thickness, fastening end portions of the PC steel bars having been passed through said flanges and the existing pier to fix the steel segment onto the wall surface; and placing concrete in the circular-arc protruded spaces between the steel segments and the wall surface to integrate the steel segments onto the wall surface of the existing pier, providing concrete blocks on the end surfaces in the direction of the thickness which is perpendicular to the wall surface of the existing pier; and connecting the concrete blocks to the end portions of the steel segments with PC steel bars.

6 Claims, 5 Drawing Sheets

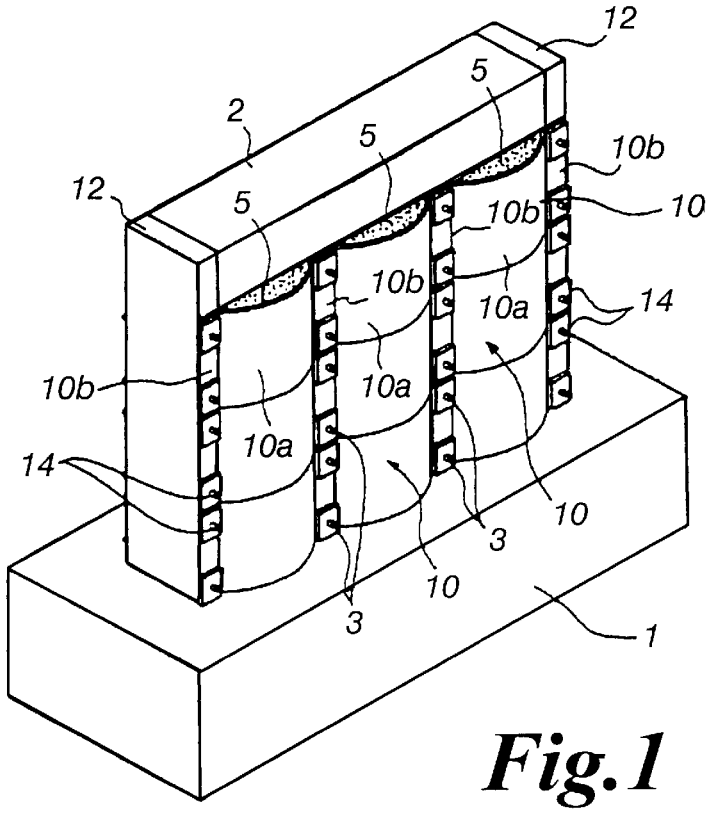
Fig.1
Fig.2
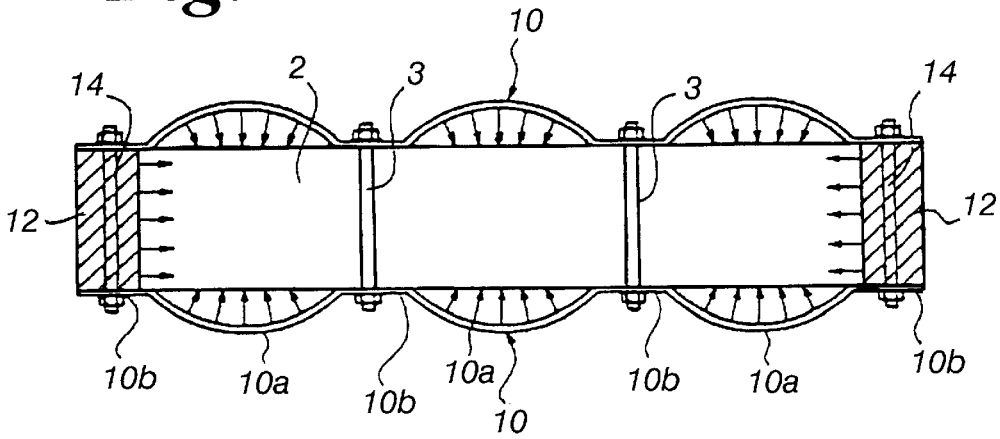

(horizontally integral type)

(horizontally divided type)

METHOD FOR REINFORCING WALL STRUCTURE

BACKGROUND OF THE INVENTION

1. Field of the Invention

The present invention relates to a method for reinforcing an existing wall structure, and preferably for reinforcing a ferroconcrete wall type pier or the like.

2. Description of the Prior Art

Known methods for reinforcing existing ferroconcrete piers include steel lining methods and concrete lining methods. Further, a method using steel segments has been disclosed by the present applicant in Japanese Laid Open Patent Publication No. JP-9,209,580.

The method using steel segments will be described with reference to FIGS. 8*a* and 8*b*. This method employs: a plurality of PC steel bars 3 inserted into a plurality of holes which are pierced through an existing wall type pier 2, in the direction of its thickness, installed on a bridge pedestal 1; and a plurality of steel segments 4, each of which are formed into a column having a cross-section in the shape of a circular-arc, and which are integrally provided with connecting flanges 4*a* at both sides of each circular-arc column in the width direction. Several stages of steel segments 4, which are arranged adjacent to each other sideways, are vertically arranged onto the wall surface of the pier 2 by superimposing the respective flanges 4*a*. The PC steel bars 3 are allowed to pass through a plurality of holes formed in the flanges 4*a* and the holes of the pier 2. The end portions of the PC steel bars 3 are then screwed, and the steel segments 4 are fixed onto the wall surface. Then, concrete 5 is placed into the circular-arc-like space between the steel segments 4 and the wall surface, and the steel segments 4 are integrated to the wall surface of the pier 2. The PC steel bars 3 are then tensioned to impart restricting force to the concrete.

Since a plurality of steel segments is divided in the vertical and horizontal direction, this method is applicable to a pier having any cross-section.

Compared with the steel lining method and the concrete lining method, the segment method is simple in structure, realizes a larger concrete restricting effect, and increases earthquake-resistance ability. The segment method also eliminates the necessity of providing a form required for the concrete lining method, thereby achieving labor-saving of construction and shortening of construction period.

FIG. 8*a* shows an example in which two pieces of the PC steel bars are provided for each steel segment; FIG. 8*b* shows an example in which three pieces of the PC steel bars are provided for each steel segment.

The above-described segment method, however, has the following technical problems.

The restricting force applied in the axial direction of the pier, that is, to the wall surface, becomes large by provision of the steel segments and the PC steel bars, and a sufficient earthquake-resistance ability of the wall surface is obtained. However, since the side surfaces (end surfaces) of the pier, which are located in the direction perpendicular to the axial direction, are not treated, when a large vibration is applied to the side surfaces of the pier, the covering concrete on the side surfaces is extruded by buckling of the main reinforcement, and damages progress therefrom. Therefore, not only is the earthquake-resistance ability decreased, but also the appearance is harmed.

Further, since the steel segments are divided into a plurality in the horizontal direction, there is a limitation in introducing the restricting force. This also complicates both the operation to superimpose the flanges onto each other, and the crane operation for carrying the divided steel segments upon actual assembly thereof.

OBJECT OF THE INVENTION

The present invention solves the above problems related to the reinforcement method using steel segments. The object of the present invention is to provide a method for reinforcing an existing wall structure which is capable of preventing buckling of end surfaces, and improving earthquake-resistance ability of the wall structure by imparting restricting forces, even to the end surfaces of the wall.

SUMMARY OF THE INVENTION

To achieve the above object according to the present invention, there is provided a method for reinforcing an existing wall structure which includes the steps of:

attaching steel segments in a plurality of stages onto the wall surface of the existing wall structure, each of the steel segments being formed into a cylinder-like form that has a continuous cross-section in the shape of a circular-arc, and having flanges for connection which are integrally provided on both sides of each circular-arc body in the width direction;

allowing a plurality of PC steel bars to pass through a plurality of holes formed in the flanges and a plurality of holes pierced through the existing wall structure in the direction of its thickness;

screwing the end portions of the PC steel bars having been passed through the flanges and the existing wall structure to fix said steel segments onto the wall surface; and placing concrete into the circular-arc protruded spaces between the steel segments and the wall surface to integrate the steel segments onto the wall surface of the existing wall structure.

The above method is characterized by further including the steps of:

providing reinforcing bodies on end surfaces of the existing wall structure in the direction perpendicular to the wall surface thereof; and connecting the reinforcing bodies to the end portions of the steel segments.

Therefore, it becomes possible to apply restricting forces even to the end surfaces of the existing wall structure in the direction perpendicular to the thickness direction thereof, and hence, possible to improve earthquake-resistance ability of the wall structure.

The reinforcing bodies may be newly constructed concrete blocks, and may have a structure, wherein the flanges provided on both end portions of the steel segments are positioned on a portion of the concrete blocks being at the same surface level as that of the wall surface, and PC steel bars are allowed to pass through the flanges and the concrete blocks and be fastened to fix the concrete. On the other hand, the reinforcing bodies may be flat steel plates which may be integrated with the end portions of the steel segments by welding. Further, the reinforcing bodies may be curved steel plates which are integrated with the end portion of the steel segments by welding in such a manner as to surround the end surfaces of the existing wall structure, and the structure thereof may be such that concrete is placed into the protruded portions formed between the curved steel plates and the end surfaces of the existing wall structure.

In the method of the present invention, an active restricting effect can be obtained by tensioning the PC steel bars after placing and curing the concrete.

The steel segments may be a unit which includes a plurality of circular-arc columns arranged sideways, and flanges connecting the respective adjacent columns to each other and integrating the same. Being so, it becomes possible to simplify the arrangement operations of the steel segments, and to alleviate limitations upon introducing restricting force by the PC steel bars.

BRIEF DESCRIPTION OF THE DRAWINGS

FIG. 1 is a perspective view showing a first embodiment of the present invention applied to reinforce an existing pier;

FIG. 2 is a sectional plan view of the first embodiment;

FIGS. 3*a* and 3*b* are diagrams illustrating deformation of the steel segments when a force perpendicular to the axial direction of the pier is applied to the steel segment, wherein FIG. 3*a* shows the deformation of the steel segment of the present invention, and FIG. 3*b* shows the deformation of the steel segment of the prior art;

DETAILED DESCRIPTION OF THE PREFERRED EMBODIMENTS

Embodiments of the present invention will be described hereinafter with reference to the accompanying drawings. FIGS. 1 and 2 show a first embodiment of the present invention applied to an existing wall-type pier. It is to be noted that in each embodiment, parts corresponding to those described in the prior art are indicated by the same reference numbers, and different reference numbers are used only to indicate different parts or newly added parts.

A steel segment 10 used for the reinforcing method in this embodiment is composed of such a unit which includes three circular-arc columns 10*a* arranged sideways and integrally connected to the respective adjacent columns by flanges 10*b*. The units are vertically arranged in three stages onto each wall surface of an existing pier 2. The flanges 10*b* of the steel segments 10 arranged at opposed position are connected to each other by PC steel bars 3 having been passed through holes formed in the flanges 10*b* and holes pierced through the pier 2.

Figure 8A:
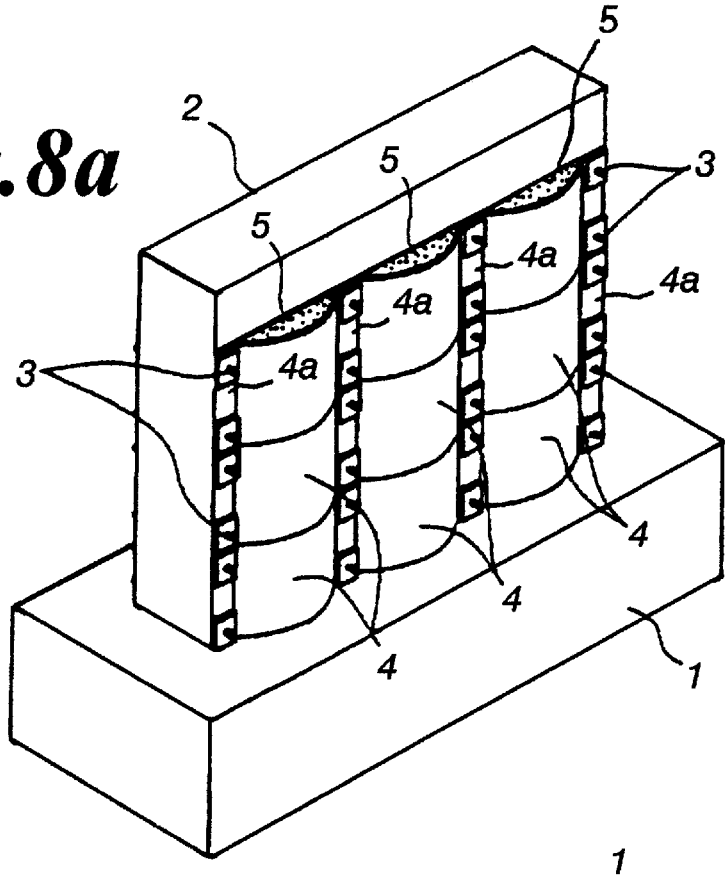
FIGS. 8*a* and 8*b* are perspective views showing a pier reinforced by a reinforcing method of the prior art.

The PC steel bars 3 are provided at two points, i.e., on the upper and lower sides of each flange 10*b*, alike the prior art shown in FIG. 8*a*.

Concrete blocks 12 provided as reinforcing bodies are integrally formed, in advance, on both side surfaces (end surfaces) of the pier 2 in the direction perpendicular to the axial direction thereof.

Upon assembly of the steel segments 10, the flanges 10*b* are abutted to the portion of the concrete blocks 12 which is on the same surface level as that of the wall surface at each end of the pier 2. PC steel bars 14 are allowed to pass through holes pierced through the concrete blocks 12, and both ends of the PC steel bars 14 are connected to the flanges 10*b* at the end portions of the steel segments 10.

The basic procedure for construction of the above reinforcing structure is as follows:

(1) The surface of the concrete body of a pier 2 is coarsened by chipping or the like.

(2) Forms are installed on side surfaces of the pier 2, and concrete is newly placed into the forms. At this time, the holes, through which the PC steel bars 14 pass, may be formed in advance by the forms, but the holes may be pierced later on.

(3) Along with the concrete placing operation, the wall surface of the pier 2 is to be pierced using a tunneling drill with a specific pitch, followed by ultrasonic drilling, to form through-holes in the direction of the thickness of the pier 2.

(4) The pierced holes of the pier 2 are treated with grease or the like to prevent adhesion. Then, the PC steel bars 3 are inserted into the pierced holes of the pier 2.

(5) After concrete blocks 12 obtained by newly placed concrete are cured, the forms are removed and the PC steel bars are inserted into the pierced holes of the concrete blocks 12. Then, steel segments 10 are attached onto both sides of the wall surfaces of pier 2, and the ends of the PC steel bars 3 and 14, projecting from flanges 10*b*, are fastened with nuts so as to connect PC steel bars to the steel segments 10.

The arrangement operation of the steel segments 10 is performed by lifting each steel segment 10 sequentially from the lower side by a crane or the like. This operation is simple compared to the operation required by the method of the prior art because the steel segments 10 of the present invention are composed of a unit in which the individual steel segments are integrally arranged and connected to each other sideways.

(6) Concrete 5 is placed into the protruded portions between the steel segments 10 and the wall surface of the pier 2, and is cured.

(7) The PC steel bars 3 and 14 are fastened with nuts, and post-tension is imparted to the PC steel bars, whereby an active restricting effect is obtained.

The pier 2 thus reinforced has a shape in which circular-arc cylinders are arranged sideways on the front and back surfaces of the pier 2, and therefore, the external appearance exhibits a new design.

The directions of the restricting force are shown by arrows in FIG. 2. As is shown in this figure, restricting force is applied even to the side surfaces of the pier 2 by installing the concrete blocks 12. This is because flexural reinforcement, that is, flexural rigidity is given to the concrete blocks 12 by imparting post-tension to the PC steel bars 14 located at the end portions of the pier 2 so as to prevent buckling of the end surfaces of the pier 2.

Figure 3A:
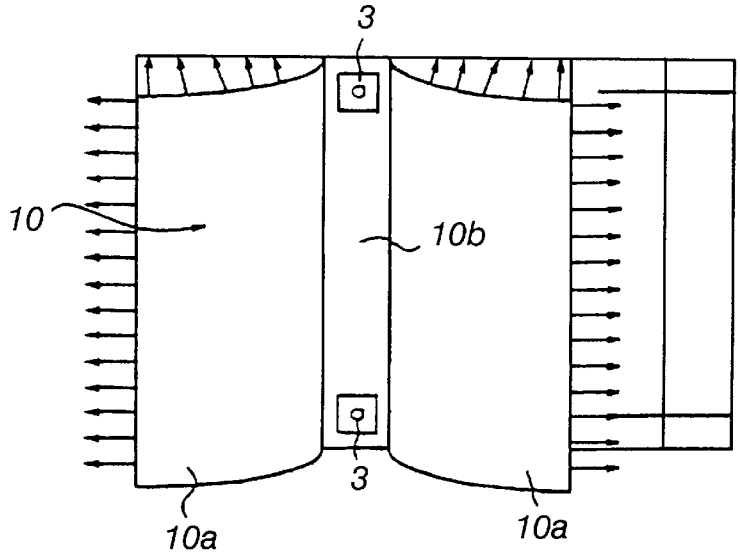
Figure 3B:
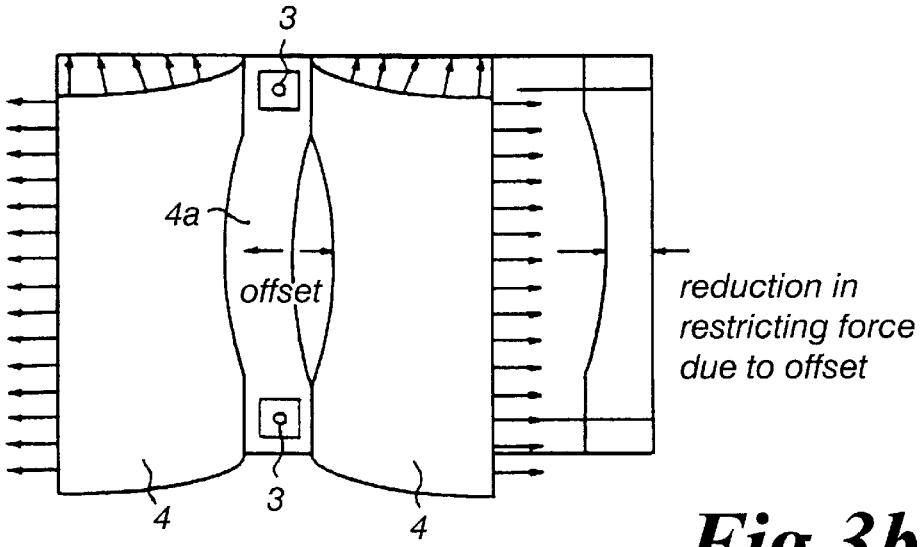

FIGS. 3*a* and 3*b* show the degree of deformation, in relation to external force, of the integral type segment 10 of the present invention in comparison to that of the prior art wherein the steel segments 4 are horizontally divided into individual segments with flanges 4*a* superimposed to each other.

According to the flange-superimposed-type segments of the prior art, when pull strength in the direction perpendicular to the axial direction of the pier 2, as shown by arrows in FIG. 3*b*,is applied thereto, the offset between the adjacent segments 4 becomes larger with distance from the PC steel bars 3. Therefore, the restricting force becomes smaller with distance from the PC bars, and is minimized at the center portion between the PC steel bars 3.

On the contrary, according to the flange-integrated-type segments of the present invention, the above offset is fully eliminated, and therefore, the restricting force in accordance to the rigidity of the flange can be maintained, and it is possible to reduce loss in restricting force.

Figure 8B:
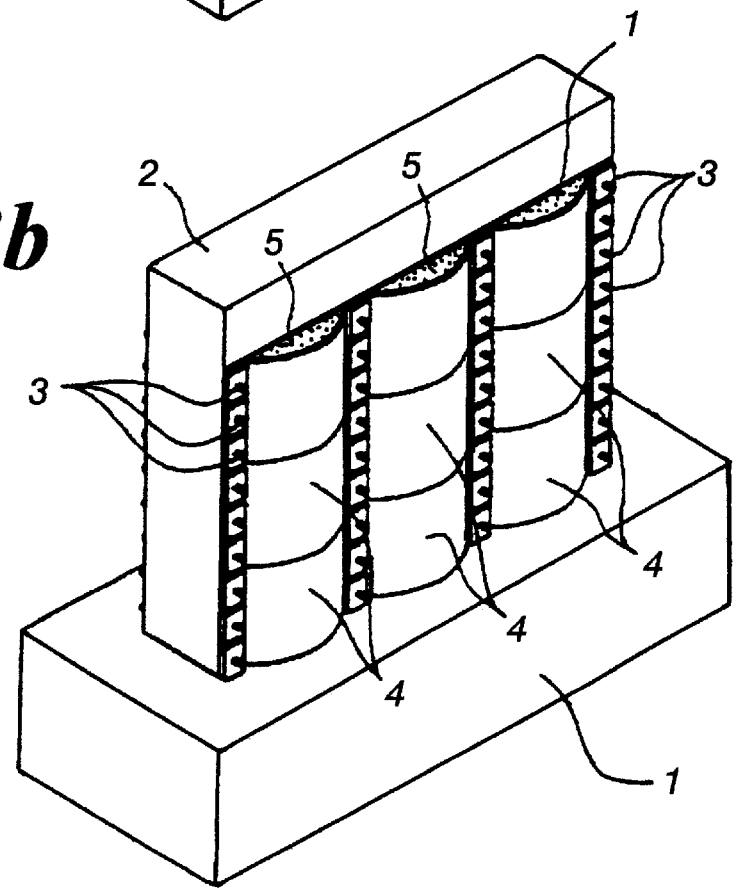

Because of the above reason, in the prior-type steel segments, the PC steel bars are disposed at three points of each flange in the vertical direction as shown in FIG. 8*b* to compensate for the reduction in restricting force; however, according to the present invention, it is possible to obtain a sufficient restricting effect even if the PC steel bars are disposed only at two points, i.e., on the upper and lower sides of each flange.

Figure 4:
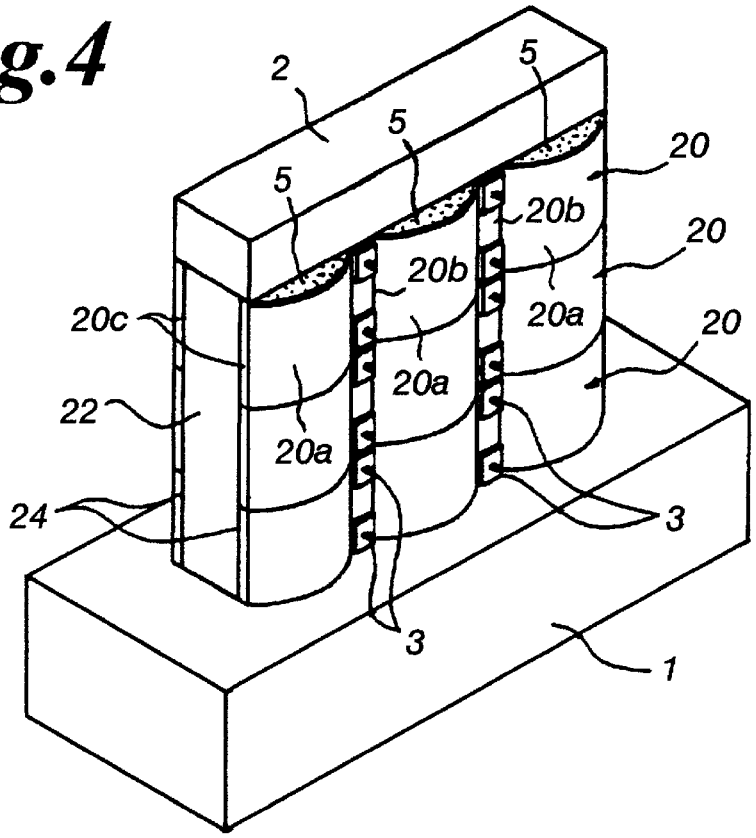
FIG. 4 is a perspective view showing a second embodiment of the present invention applied to an existing pier.
Figure 5:
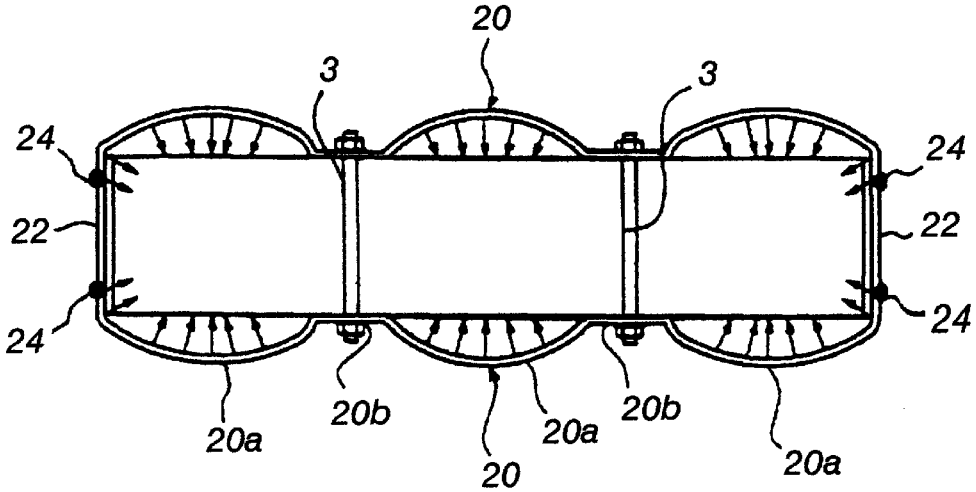
FIG. 5 is a sectional plan view of the second embodiment.

FIGS. 4 and 5 show a second embodiment of the present invention. As shown in these figures, a steel segment 20 is composed of a unit in which three circular-arc columns 20*a* are arranged sideways with the respective adjacent columns integrally connected to each other by flanges 20*b*.

In addition, both side end portions of the unit are folded at both the side surfaces of the existing pier 2. These folded portions 20*c*, positioned on both side surfaces of the pier 2, are integrally joined by welding (shown by reference numeral 24) to flat steel plates 22 disposed as reinforcing bodies onto both side surfaces of the pier 2.

The units are vertically arranged in three stages on each wall surface of the pier 2. The flanges 20*b* of the opposed steel segments 20 are connected to each other by PC steel bars 3 which are passed through holes pierced in the pier 2. The PC steel bars 3 are disposed at two points, i.e., on the upper and lower sides of each flanges 20*b*, alike the prior art shown in FIG. 8*a*.

Restricting force directions are shown by arrows in FIG. 5. The restricting force applied to the side surfaces of the pier 2 are obtained by the flat steel plates 22. This force is slightly smaller than that of the first embodiment because the plane of the flat steel plates 22 resists against extrusion of the covering concrete; however, in this embodiment, it is possible to reduce the number of the PC steel bars 3 and the corresponding number of the pierced holes. In addition, since the units are mounted onto the side surfaces merely by welding, the present embodiment has the advantage of simplifying the reinforcing structure and facilitating the construction thereof.

Figure 6:
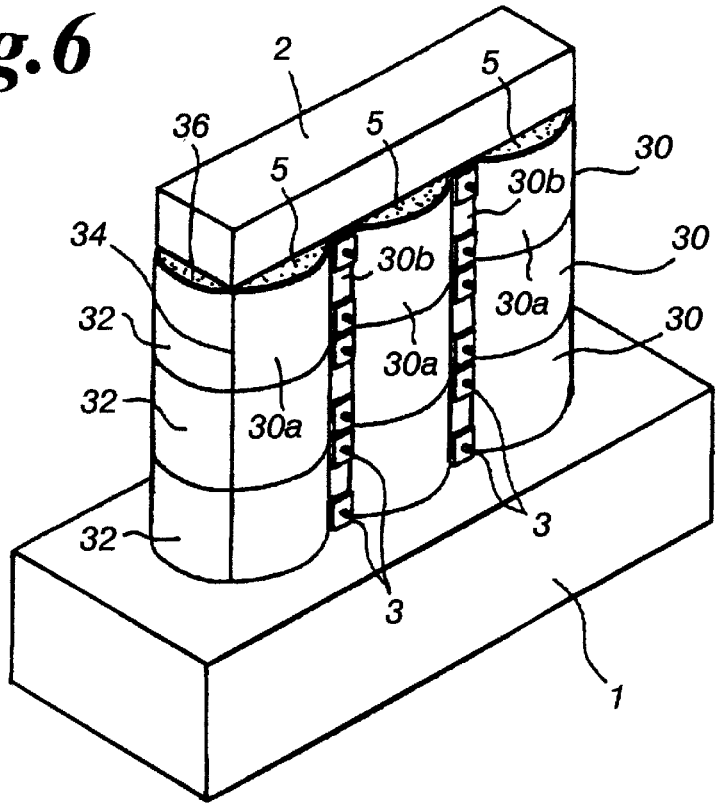
FIG. 6 is a perspective view showing a third embodiment of the present invention applied to an existing pier.
Figure 7:
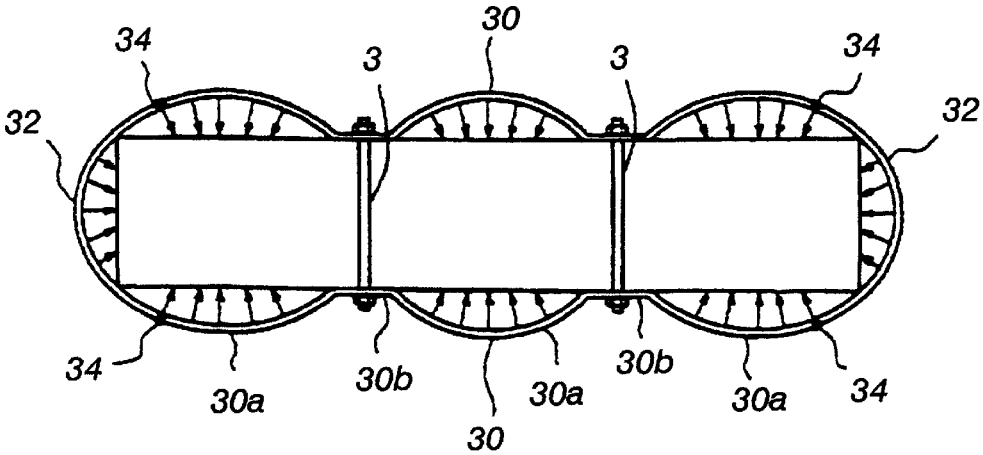
FIG. 7 is a sectional plan view of the third embodiment.

FIGS. 6 and 7 show a third embodiment of the present invention. As shown in these figures, a steel segment 30 is composed of a unit in which three circular-arc columns 30*a* are arranged sideways with the respective adjacent columns integrally connected to each other by flanges 30*b*.

In addition, the columns 30*a* positioned at both sides of the unit are integrally joined by welding 34 to both side portions of curved steel plates 32 disposed as reinforcing bodies onto both side surfaces of the existing pier 2.

The units are vertically arranged in three stages onto each wall surface of the pier 2. The flanges 30*b* of the opposed steel segments 30 are connected to each other by PC steel bars 3 which are passed through holes pierced in the pier 2. The PC steel bars 3 are disposed at two points, i.e., on the upper and lower sides of each flanges 30*b*, alike the prior art shown in FIG. 8*a*.

Although a same number corresponding to the steel segments 30, that is, three stages of curved steel plates 32 are vertically arranged in FIG. 6, they may be arranged alike that of the second embodiment, that is, in one stage.

In addition, concrete 36 is placed to fill the protruded space surrounded by the curved steel plates 32 and the side surface of the pier 2, just as concrete 5 is placed into the protruded spaces between the steel segments 30 and the wall surface of the pier 2.

In this embodiment, restricting force applied to the side surfaces of the pier 2 is obtained by the curved steel plates 32 and the concrete 36 filled therewithin. This restricting force is very large, as shown by the arrows in FIG. 7, because this is given by the geometrical structure of the curve-like surface. As compared with the first embodiment, since the number of PC steel bars 3 and the corresponding pierced holes are decreased, the present embodiment has the advantage of simplifying the reinforcing structure and facilitating the construction thereof.

It is to be noted that in each embodiment, the PC steel bars 3 and 14 may either be fastened or not. In case the PC steel bars 3 and 14 are fastened, there is provided an active restricting state; in case the PC steel bars 3 and 14 are not fastened, there is provided a passive restricted state.

While discussion of each embodiment has been made of a reinforcing method applied to a pier, the present invention can of course be applied to methods for reinforcing a bridge pedestal and other general self-sustained existing wall structures.

As described in the above embodiments, since restricting forces are imparted even to the end surfaces of the wall structure, the method for reinforcing an existing wall structure according to the present invention is effective in preventing buckling of the end surfaces of the wall structure and increasing earthquake-resistance ability.

The present invention is also effective in: simplifying the operation of arranging the steel segments, alleviating the limitation upon introduction of reinforcing forces by PC steel bars, and hence reducing the number of PC steel bars and the corresponding pierced holes.

What is claimed is:

1. A method for reinforcing an existing wall structure comprising the steps of:

attaching steel segments in a plurality of stages onto a wall surface of the existing wall structure, each of said steel segments being formed into a column having a continuous cross-section in the shape of a circular-arc, and being integrally provided with flanges for connection on both sides of each circular-arc column in the width direction;

allowing a plurality of PC steel bars to pass through a plurality of holes pierced in said flanges and through a plurality of holes pierced through the existing wall structure in the direction of the thickness, and screwing end portions of said PC steel bars having been passed through said flanges and the existing wall structure to fix said steel segment onto the wall surface; and placing concrete in the circular-arc protruded spaces between said steel segments and the wall surface to integrate said steel segments onto the wall surface of the existing wall structure;

characterized in:

providing reinforcing bodies on end surfaces, in the direction of the thickness which is perpendicular to the wall surface of the existing wall structure; and connecting said reinforcing bodies to the end portions of said steel segments.

2. A method for reinforcing a wall structure according to claim 1, wherein said reinforcing bodies are newly constructed concrete blocks;

said flanges positioned at both end portions of said steel segments are disposed onto portions of said concrete blocks being on the same surface level as that of the wall surface; and said PC steel bars are allowed to pass through said end side flanges and said concrete blocks and fastened to fix said concrete blocks to said end side flanges.

3. A method for reinforcing a wall structure according to claim 1, wherein said reinforcing bodies are flat steel plates to be integrated with the end portions of said steel segments by welding.

4. A method for reinforcing a wall structure according to claim 1, wherein said reinforcing bodies comprise:

curved steel plates to be integrated with the end portions of said steel segments by welding in such a manner as to surround the end surfaces of the existing wall structure; and concrete placed into protruded portions formed between said curved steel plates and the end surfaces of the existing wall structure.

5. A method for reinforcing a wall structure according to claim 1, further comprising curing said concrete; and tensioning said PC steel bars after curing said concrete.

6. A method for reinforcing a wall structure according to any one of claims 1 to 5, wherein each of said steel segments is a unit, said unit being formed by:

arranging a plurality of adjacent circular-arc columns; and connecting said respective adjacent columns to each other.

* * * * *